United States Patent [19]

Beretta

[11] 4,265,044

[45] May 5, 1981

[54] DOUBLE-BARREL SHOTGUN

[75] Inventor: Pier C. Beretta, Gardone, Italy

[73] Assignee: Fabbrica D'Armi Pietro Beretta S.p.A., Gardone, Italy

[21] Appl. No.: 2,710

[22] Filed: Jan. 10, 1979

[51] Int. Cl.[3] ..... F41C 7/00

[52] U.S. Cl. ..... 42/41; 42/42 R

[58] Field of Search ..... 42/41, 42

[56] References Cited

U.S. PATENT DOCUMENTS

| | | | |
|---|---|---|---|
| 2,711,042 | 6/1955 | Simmons | 42/42 R |
| 3,016,645 | 1/1962 | Miller | 42/42 R |
| 3,421,243 | 1/1969 | Browning | 42/42 R |
| 3,537,203 | 11/1970 | Weatherby | 42/42 R |
| 3,808,724 | 5/1974 | Linde | 42/42 R |

*Primary Examiner*—Donald P. Walsh

[57] ABSTRACT

The pivotally mounted hammers of a double-barrel shotgun are each provided with a pair of trip teeth that are engaged alternately by a forwardly directed projection on each of a pair of pivotally mounted trip levers for arming and releasing the hammers. A pair of trip springs are utilized for displacing the hammers. Guide rods associated with the trip springs and the hammers allow slight angular displacement of said hammers in their disengaged position.

10 Claims, 5 Drawing Figures

DOUBLE-BARREL SHOTGUN

BACKGROUND OF THE INVENTION

1. Field of the Invention

The present invention relates generally to double-barrel shotguns of the "side-by-side" and "over-under" varities, and, more particularly, to percussion hammers for such shotguns as well as to means for engaging and tripping of said hammers.

2. Description of the Prior Art

As is well known, each percussion hammer in a shotgun is held in an armed position by means of a trip lever, which cooperates with an arresting tooth provided on the hammer and, simultaneously, directly or indirectly engages the trigger for the release of the percussion member. In the most common assemblies, the arresting tooth is provided in the lower part of the hammer or, in any case, in a location substantially below the pivoting axis of the hammer.

However, with such a construction, the lever arm for arresting the hammer is, of necessity, quite short, both with respect to the hammer structure and with respect to the placement of the various elements of the mechanism. This usually requires a greater effort in the operation of arming the hammer and a considerable loss of uniformity and ease of operation of the shotgun, due to the greater force to be applied during the disarming phase of the hammer.

Also known are arrangements in which the arresting tooth of the hammer is provided in the upper part of thereof, so that the trip lever cooperating therewith must be readied in conformity therewith without eliminating the above-mentioned disadvantages.

In the heretofore known arrangements, if it was desired to fully and safely arm the hammers, it was always necessary to completely open the barrels of the shotgun, which operation was not always effected correctly by the hunter or user, especially in the case of "over-under" shotguns, when the shell casing had to be removed from only the upper barrel. In this case, the partial opening of the barrels does not result in either the arming of the hammer or the arresting thereof so that, upon the subsequent closing of the barrels, there always remains the possibility that one hammer may violently strike its respective percussive element causing the accidental discharge of the firearm.

Furthermore, the heretofore known arrangements have the disadvantage that each hammer, when released and pushed by its respective trip spring, has the tendency to constantly engage against the rear terminal of the respective percussion member or striker, thus keeping the striker forwardly displaced. As a result, when the barrels are being opened, the striker, especially the one corresponding to the lower barrel of an "over-under" shotgun, rubs against the bottom of the cartridge and, which is worse, against the breech of the barrel, with consequent reciprocal wear and tear.

SUMMARY OF THE INVENTION

Each of the hammers of a double barrel shotgun has a pair of trip teeth positioned in the rear part of the hammer, so as to be displaced upwardly with respect to the pivoting axis of the hammer. The trip lever cooperating with the hammer has a portion thereof facing upwardly and with a frontal beak alternately cooperating with two trip teeth of the hammer for engagement in an armed or in a safety position, respectively. The trip spring is associated with the hammer by means of a guide-rod, so as not to disengage the hammer but to leave it free when in a rest position.

It is therefore one object of the present invention to improve upon the heretofore known mechanisms of arming and releasing the hammers of shotguns.

Another object of the present invention is to improve upon the mounting of the trip springs for such hammers, so as to obtain a smoother and safer operation of the mechanism and to eliminate the hereinabove described drawbacks of the prior art.

BRIEF DESCRIPTION OF THE DRAWING

Greater details of the invention will be given hereinbelow in the following description thereof, with reference to the accompanying drawings, which are not to be construed limitatively, and in which.

DESCRIPTION OF THE PREFERRED EMBODIMENT

Figure 1:
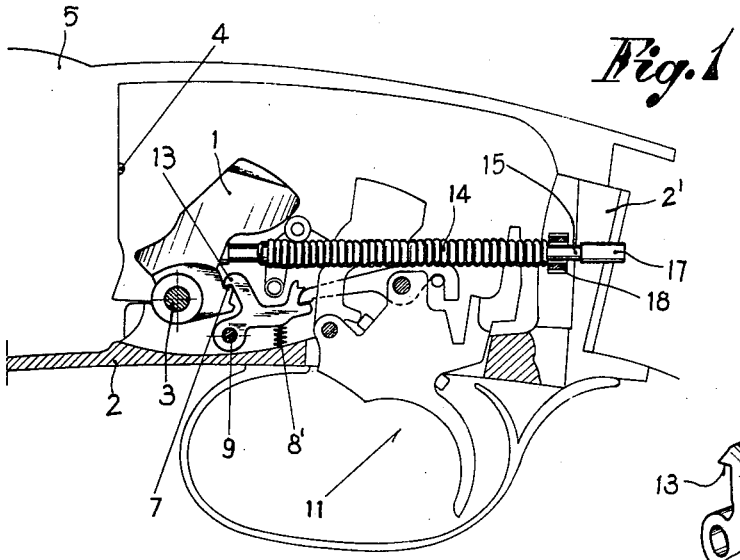
FIGS. 1 and 2 are fragmentary side elevational views in section of the mechanism with a hammer in an armed and a released position, respectively.
Figure 4:
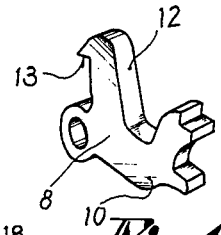
FIGS. 3 and 4 are perspective views of, respectively, a hammer and its trip lever.

Referring now to the drawings, reference character 1 generally designates one of the two hammers of an "over-under" double-barrel shotgun or a "side-by-side" double-barrel shotgun, the hammers being pivoted on the underguard 2 by means of a transverse pin 3, so as to be angularly displaced to and from their respective striker 4 and guided in a manner known per se and conventional within the body of the lever 5 of the shotgun.

Figure 2:
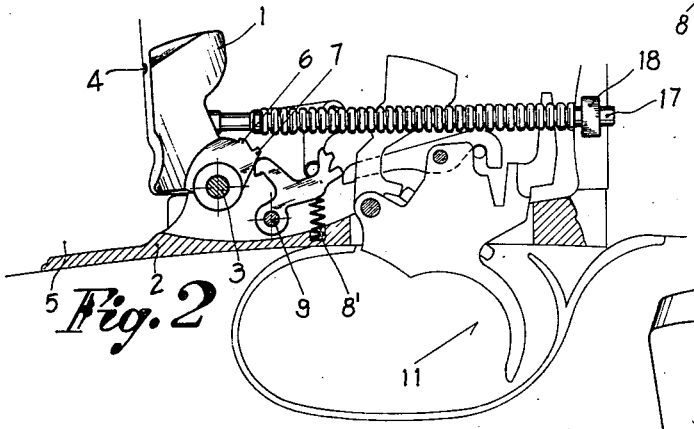
Figure 3:
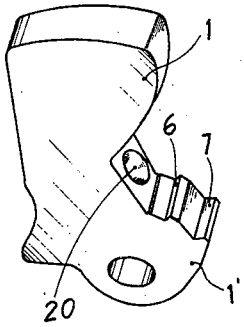
Figure 5:
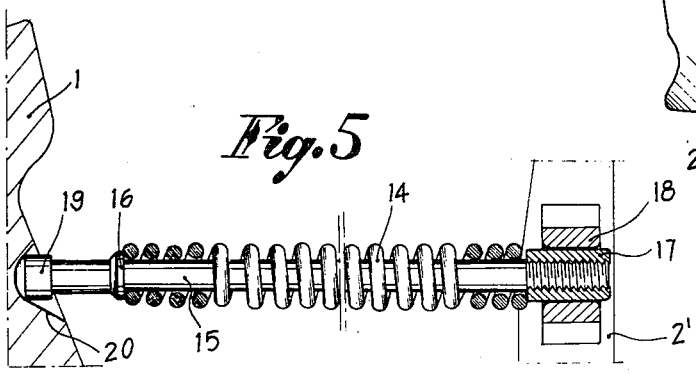
FIG. 5 is a partial, enlarged, sectional view of the mounting of the trip spring of the hammer.

The hammer 1 has, on its rearwardly facing surface and at an intermediate height, a step-like portion 1' on which there are located two trip teeth 6, 7, one positionally following the other and positioned in a plane which is above the axis or pivoting axis of the hammer 1 when the hammer 1 is in the released position, such as shown for example in FIG. 2. One of the teeth, for example tooth 6, is so constructed as to define the arming position of the hammer 1 while the other tooth 7 constitutes the means for safety-positioning the hammer 1 as described later hereinbelow.

The hammer 1 has associated therewith a respective trip lever 8 pivoted on the underguard 2 by means of a pin 9 and having a first portion 10 and a second portion 12. The first portion 10, substantially horizontal in the armed position faces and cooperates with a trigger 11 in a manner known per se; the second portion 12, directed upwardly and positioned behind the hammer 1, has a frontwardly facing projection 13 which engages, alternately, one or the other of the teeth 6, 7 of the hammer 1.

The trip lever 8 is in turn urged by a compression spring 8', which acts upwardly in a substantially vertical direction between the underguard 2 and the trip lever 8, so as to keep the portion 12 thereof constantly adjacent the hammer 1. The trip lever spring 8' is interchangeable so as to allow the desired variation of the force applied to the hammer 1 by the trip lever 8.

The position of the arresting teeth 6, 7 with respect to the pin 3 allows the obtainment of a lever arm of such length as to affect and favorably influence the ease and smoothness of the operation for a more correct and precise utilization of the firearm.

Furthermore, while the tooth 6 allows the blocking of the hammer 1 in the correct armed position, which is achievable by means of a full opening of the barrels, the tooth 7 serves to arrest the hammer 1 in the event of an incomplete arming of the hammer 1 caused by a partial opening of the barrels. In this case, in fact, the projection 13 of the trip lever 8 engages the tooth 7 and insures the blockage of the hammer 1 so as to prevent the uncontrolled or accidental action of the striker 4 and the corresponding firing of the cartridge.

Furthermore, the tooth 7 also serves as engagement means with the trip lever 8, when tooth 6 is worn and there is no possibility of a sure engagement of the projection 13 of the trip lever 8 with the arresting tooth 6.

There is, therefore, achieved a greater safety in the operation of the mechanism and, consequently, the elimination of any possible uncontrolled or accidental release of the hammer 1.

According to another feature of the invention, each hammer 1 is associated with a trip spring 14 of predeterminedly regulated load so as not to affect the hammer 1 when the latter is in a rest position, (hammer 1 already released), and so as to keep it free and disengaged from the striker 4. To this end, the spring 14 is mounted on on a guide rod 15 and is arrested with a pre-load between a striking collar 16 provided in the vicinity of one of the terminals of the guide rod and an internally threaded regulating sleeve 17 threaded onto the opposite extremity or terminal of the guide rod 15.

Furthermore, while the threaded extremity of the rod 15 is guided within an opening provided in a ring 18 of the support 2' of the underguard 2, the opposed extremity of the guide rod 15 is provided with a hemispheric-shaped head 19 and is lodged in a seat 20 provided in the rear part of the hammer 1.

The pre-loading of the spring 14 is regulated by threading or unthreading the regulating sleeve 17 as desired, on the guide rod 15. In any case, the maximum extension or length of the spring is limited by the regulating sleeve 17 with the striking collar 16 provided on the guide rod 15, the extension or length being a function of the distance of the hammer 1 from the confronting surface of the ring 18 and of the freedom which the hammer 1 must have when disarmed. However, the regulating sleeve 17, as well as the guiding opening in the ring 18, have a diameter smaller than that of the spring 14, so as to force the spring 14 to rest against the ring 18 while the guide rod 15 is displaced axially within the opening during the arming and disarming operations.

In this manner, when the hammer 1 is moved into the armed position (FIG. 1) the spring 14 is compressed and is therefore "loaded" between the collar 16 of the guide rod 15 and the guiding ring 18. By the subsequent releasing of the hammer 1, the reaction of the spring 14 is unloaded on the guide rod 15 which then forcibly moves the hammer 1 itself toward the striker 4 for the firing thereof. However, when the spring 14 has reached its maximum extension, defined as described above by the regulating sleeve 17 and by the collar 16, the hammer 1 is not affected and is free to effect slight angular displacements, thus permitting the full return of the striker 4 to a resting position. The rubbing action of the striker head 4 against the bottom of the shell casing and against the breech of the barrels when these are being opened is thus completely avoided.

I claim:

1. A double-barrel shotgun comprising a pair of hammers pivoted on a first common pin; a pair of strikers respectively associated with said pair of hammers; a pair of trip levers each having a first portion facing upwardly and including a frontwardly directed projection for arming and releasing said hammers, said trip levers being pivoted on a second common pin; a trigger element for separately controlling the trip levers; a pair of axially elongated trip springs acting on said hammers for displacement thereof toward their respective strikers; and a tripping mechanism including first and second trip teeth formed in the rearwardly facing surface of each of said hammers, said teeth being alternately engaged by said projection on said trip levers.

2. The shotgun according to claim 1, wherein said trip teeth are positioned angularly with respect to the pivoting axis of said hammers.

3. The shotgun according to claim 1 wherein each said trip spring is exchangeable so as to modify and vary the force of said hammer.

4. The shotgun according to claim 1, wherein said trip teeth are positioned above the pivot axis of said hammer in the disengaged position.

5. The shotgun according to claim 1, wherein said trip lever is actuated by a pusher spring acting in an upward direction from below so as to keep said projection of said lever in continuous engagement with said hammer.

6. The shotgun according to claim 1 further including an axially elongated guide rod contained within each said trip spring for allowing said hammer to effect slight angular displacements when said hammers are in the disengaged position.

7. The shotgun according to claim 6, wherein each said trip spring has a predetermined load exerted between a striking collar adjacent a first extremity of said guide rod and a sleeve adjustably coupled to said guide rod proximate the second extremity thereof.

8. The shotgun according to claim 7 wherein said sleeve is threadably coupled to said rod.

9. The shotgun according to claim 6 wherein said hammer includes a seat for receiving the first extremity of said guide rod, there being further included a ring integral with a fixed portion of said shotgun for slidingly receiving the second extremity of said guide rod within an opening through said ring.

10. The shotgun according to claim 9, wherein said sleeve and said opening in said ring are of a diameter smaller than the outer diameter of said trip spring of said hammer, so that said trip spring is arrested against said ring when said hammer is armed.

* * * * *